US009115564B1

(12) United States Patent
Villines

(10) Patent No.: US 9,115,564 B1
(45) Date of Patent: Aug. 25, 2015

(54) LOADING SYSTEM

(75) Inventor: Benjamin K. Villines, Weatherford, OK (US)

(73) Assignee: Iron Horse Industries, LLC, Weatherford, OK (US)

( * ) Notice: Subject to any disclaimer, the term of this patent is extended or adjusted under 35 U.S.C. 154(b) by 813 days.

(21) Appl. No.: 13/431,436

(22) Filed: Mar. 27, 2012

(51) Int. Cl.
*E21B 33/08* (2006.01)

(52) U.S. Cl.
CPC ..... *E21B 33/08* (2013.01)

(58) Field of Classification Search
CPC ..... E21B 33/08; E21B 33/085; F16J 10/02; F16J 15/184; F16J 15/189; F16J 15/18
See application file for complete search history.

(56) References Cited

U.S. PATENT DOCUMENTS

2009/0039108 A1* 2/2009 Cohen-Zada ..... 222/25
2009/0194951 A1 8/2009 Cohen Zada Vaizman

* cited by examiner

*Primary Examiner* — Giovanna C Wright
*Assistant Examiner* — Kristyn Hall
(74) *Attorney, Agent, or Firm* — Gary Peterson

(57) ABSTRACT

A loading apparatus features a hollow barrel that can be threaded to one end of the stuffing box of a pump. A plunger having an enlarged piston can axially push the contents of the barrel into the stuffing box. The apparatus can be used to install replacement packing elements, such as seals, into the stuffing box. The barrel and the stuffing box can be coaxially engaged by mating threads. A retrieval apparatus is formed from a body have an internally threaded axial bore at one end and a transverse bore at the other. The retrieval apparatus can be used to recover a pump rod that has been retracted while packing elements are being replaced.

21 Claims, 9 Drawing Sheets

LOADING SYSTEM

SUMMARY OF THE INVENTION

An apparatus for loading a stuffing box having an internal chamber is formed from a hollow barrel and a plunger. The barrel has interior side walls that define an internal chamber having the same cross-sectional dimensions as the internal chamber of the stuffing box, the barrel having an axis. The plunger is disposed for axial reciprocal sliding movement within the internal chamber of the barrel. At one of its ends, the plunger has an enlarged piston situated within the internal chamber. A connection system releasably maintains the internal chambers of the barrel and the stuffing box in coaxial engagement.

A retrieval apparatus is formed from a body having a first end and a second end. The body includes an axially extending bore formed at the first end, and a transverse bore formed adjacent the second end. The axial bore includes internally formed threads.

BRIEF DESCRIPTION OF THE DRAWINGS

FIG. 16 shows the stuffing box of FIG. 15 at a later stage of the loading process. The retrieval apparatus has been inserted through the contents of the stuffing box, and threaded into engagement with the first rod.

DETAILED DESCRIPTION

Figure 1:
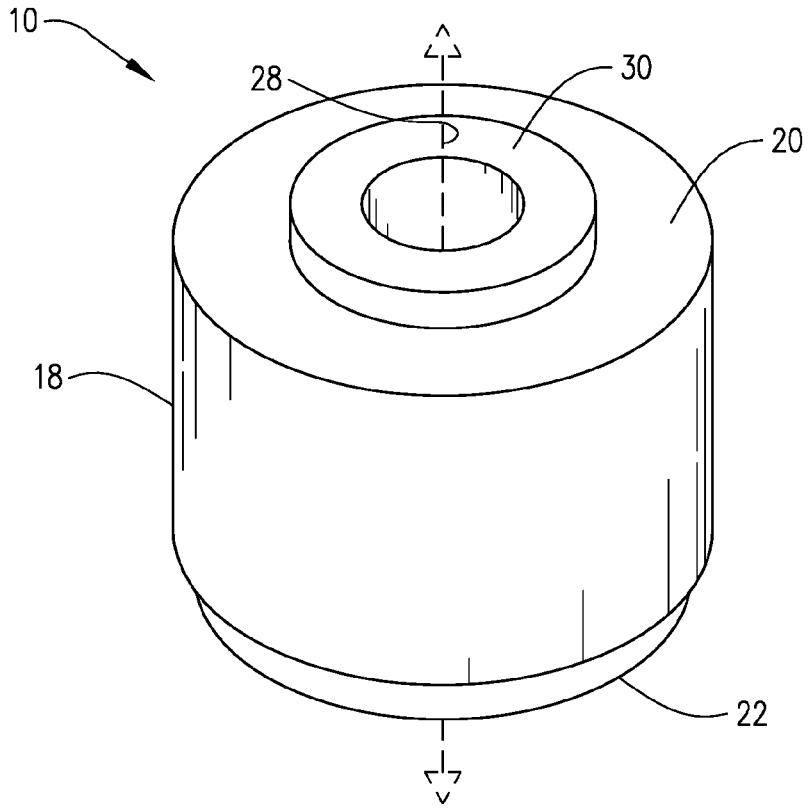
FIG. 1 is a perspective view of a loading apparatus.
Figure 2:
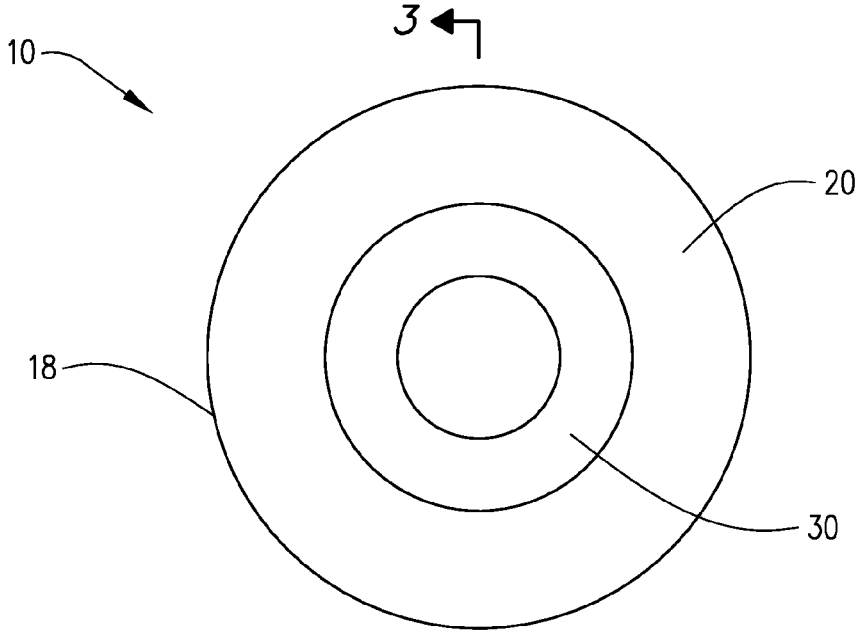
FIG. 2 is a top plan view of the loading apparatus shown in FIG. 1.

FIGS. 1-4 show a loading apparatus 10 that may be used to pack a stuffing box having an internal chamber. A stuffing box 12 suitable for use with the apparatus 10 is shown in FIGS. 10-17. The stuffing box 12 is preferably part of a pump 14, and features an internal chamber 16.

The apparatus 10 comprises a hollow barrel 18 having a first end 20 and a second end 22. The barrel 18 features interior side walls 24 that define an internal chamber 26. The cross-sectional dimensions of the internal chamber 26 should be the same as those of the internal chamber 16 of the stuffing box 12. The internal chamber 26 is symmetric about a longitudinal axis 28, about which the barrel 18 is preferably symmetric as well.

Figure 3:
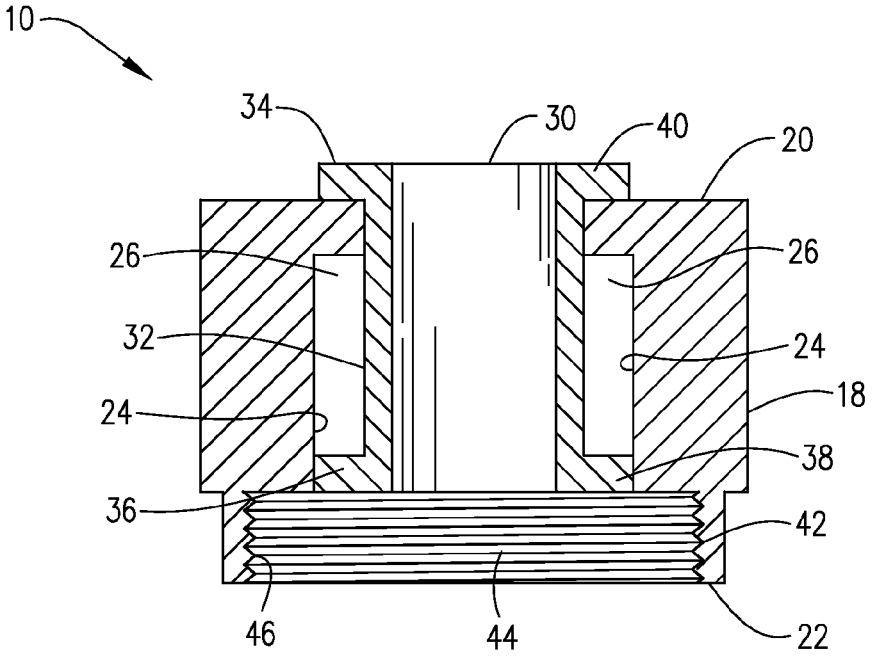
FIG. 3 is a cross-sectional view of the loading apparatus of FIG. 2, taken along line 3-3. The plunger is in its depressed position.
Figure 4:
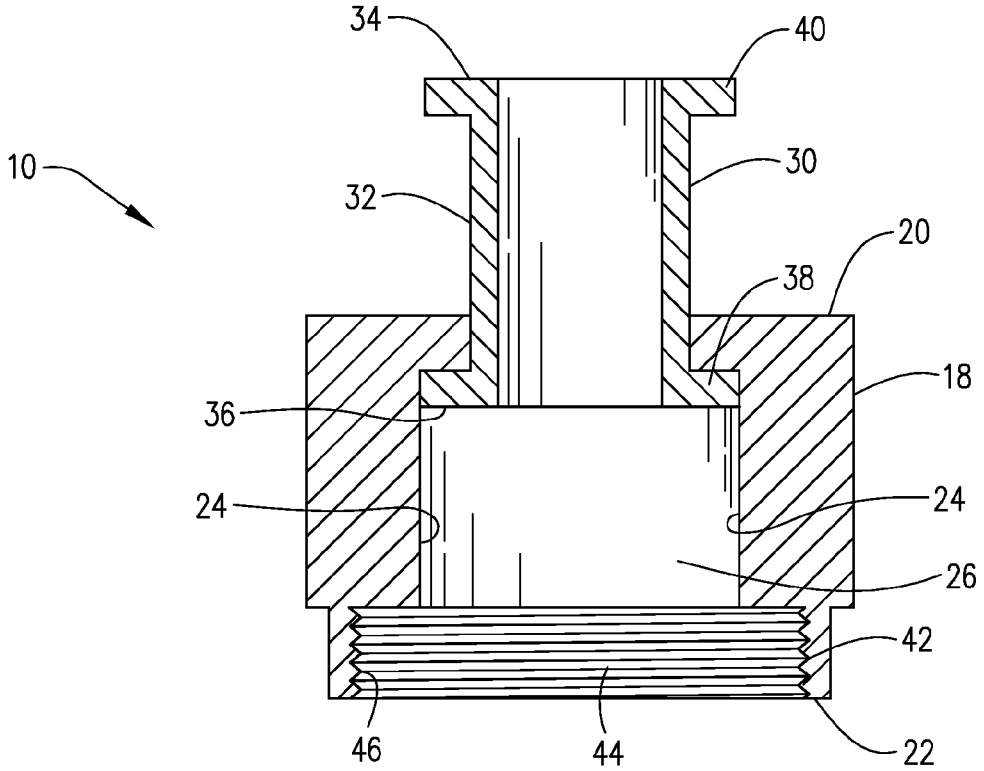
FIG. 4 is a cross-sectional view of the loading apparatus shown in FIGS. 2 and, with the plunger in its extended position.
Figure 5:
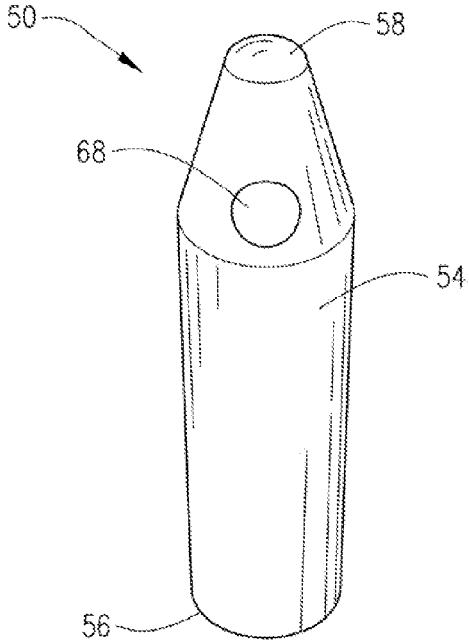
FIG. 5 is a perspective view of a retrieval apparatus.
Figure 6:
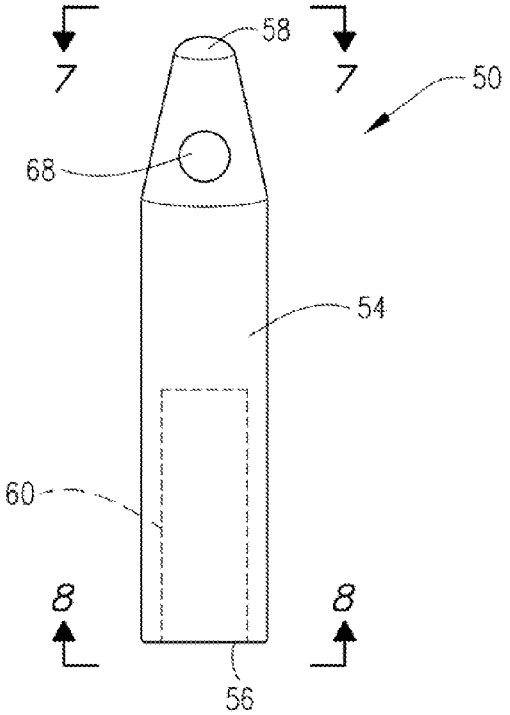
FIG. 6 is a front elevation view of the retrieval apparatus shown in FIG. 5.
Figure 7:
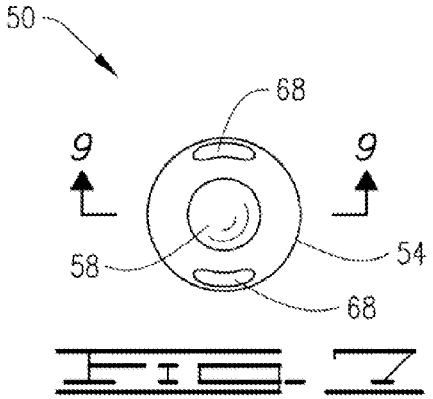
FIG. 7 is a top plan view of the retrieval apparatus shown in FIG. 6, taken along line 7-7.
Figure 8:
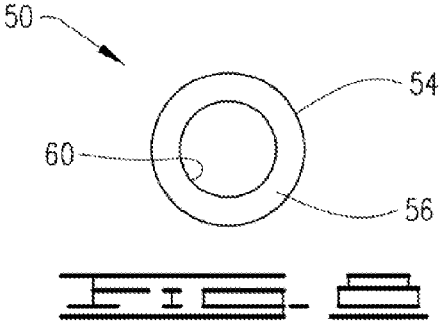
FIG. 8 is a bottom plan view of the retrieval apparatus shown in FIG. 6, taken along line 8-8.
Figure 9:
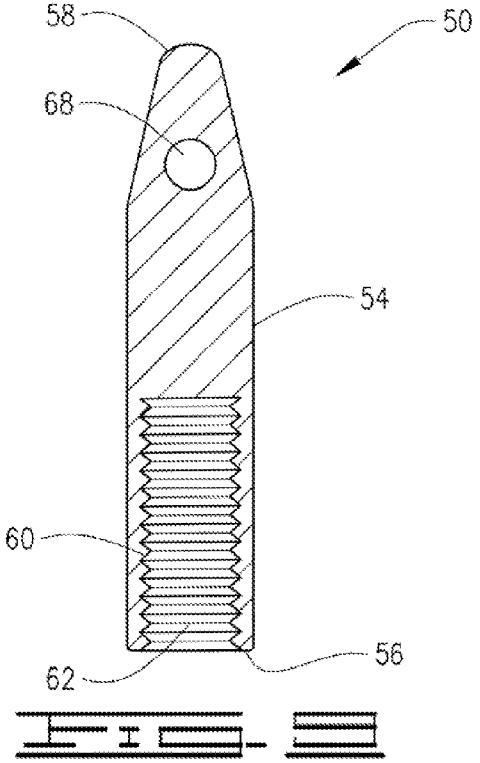
FIG. 9 is a cross-sectional view of the retrieval apparatus shown in FIG. 7, taken along 9-9.

Preferably, the internal chambers 16 and 26 are characterized by cylindrical shapes. More preferably, the exterior shaping of the barrel 18 is cylindrical along at least a portion of its length. As shown in FIGS. 3 and 4, that portion of the barrel 18 adjacent the second end 22 may have a smaller cylindrical diameter than the balance of the barrel 18.

The apparatus 10 further comprises a plunger 30 disposed for axial reciprocal sliding movement within the internal chamber 26 of the barrel 18. As shown in FIG. 4, the plunger 30 is formed from a hollow shaft 32 having a first end 34 and a second end 36.

The shaft 32 extends through the first end 20 of the barrel 18. An enlarged piston 38 is formed at the first end 34 of the shaft 32, and is situated within the internal chamber 26. The piston 38 should have an peripheral shape that conforms closely to the internal shape of chamber 26. The exterior dimensions of the piston 38 should be selected to allow it to slide within the internal chamber 26 in close, but clearing relationship to the interior side walls 24, as shown in FIGS. 3 and 4.

An enlarged flange 40 is formed at the second end 36 of the shaft 32, and is situated outside the internal chamber 26. Preferably the size and shape of the flange 40 are identical, or substantially identical, to those of the piston 38.

The plunger 30 may be moved between a depressed position, shown in FIG. 3, and an extended position, shown in FIG. 4. When the plunger is in the extended position, the internal chamber 28 is open adjacent the second end 22, and may be loaded with packing elements. When the plunger 30 is moved to the depressed position, the piston 38 axially moves the contents of the internal chamber 26 through the second end 22 of the apparatus 10.

The loading apparatus 10 further comprises a connection system 42 that can releasably maintain the internal chambers of the barrel 18 and the stuffing box 12 in coaxial engagement. Preferably, the connection system 42 comprises threads formed on a surface of the barrel 18 that can mate with threads formed on a surface of the stuffing box 12. More preferably, the connection system 42 comprises internal threads 44 formed on walls defining an axial internal bore 46 formed in the second end 22 of the barrel 18. The threads 44 should mate with corresponding threads 48 formed on an exterior surface of the stuffing box 12, shown in FIG. 12.

The barrel 18 and plunger 30 should each be formed from a strong and durable material. In a preferred embodiment, the barrel 18 is formed from aluminum, and is machined to the required shape. The plunger 30 is preferably formed from stainless steel. The shaft 32 and piston 38 of the plunger 30 are preferably fabricated as a single piece. The first end 34 of shaft 32 is then pushed through the second end 22 of the barrel 18 and through the internal chamber 26, so that it projects out of the first end 34. The flange 40 is then attached to the shaft 32 at its second end 36. The flange 40 and shaft 32 may be joined permanently, such as by welding, or they may be releasably connected, such as by one or more set screws. A releasable connection facilitates removal of the plunger 30 for cleaning.

In one preferred embodiment, the barrel 18 is characterized by a length of 2.135 inches and a maximum external diameter of 3 inches. The diameter of internal chamber is 1.75 inches. The length of the shaft 32 of plunger 30, not including the piston 38 and flange 40, is 1.65 inches. The diameter of the shaft 32, between piston 38 and flange 40, is 1.278 inches. The diameter of the flange 40 is 1.75 inches, while the diameter of the piston 38 is 1.748 inches. The piston 38 and flange 40 are each 0.2 inches thick. The threads 42 extend internally 0.5 inches from the second end 22.

FIGS. 5-9 show a retrieval apparatus 50 that may be used to move a rod having a threaded end through a packed stuffing box. A stuffing box 12 and first rod 52 suitable for use with the apparatus 50 are shown in FIGS. 10-17. The first rod 52 is extendable through the stuffing box 12, and both preferably comprise parts of the same pump 14.

The apparatus 50 is formed from an elongate body 54 having a first end 56 and a second end 58. Preferably, the length of the body should exceed the length of the stuffing box 12. The body 54 should be characterized by cross-sectional dimensions that are sufficiently small to allow it to be axially inserted and clearingly received through the stuffing box 12 and its contents. More preferably, the cross-sectional dimensions of the body 54 are the same as those of the first rod 52.

An axially extending bore 60 is formed at the first end 56. Internal threads 62 are formed in the walls that define the bore 60. These threads 62 should be matable with corresponding threads 64 formed adjacent an end 66 of the first rod 52, shown in FIG. 11.

Adjacent its second end 58, the body 54 is preferably tapered, with cross-sectional dimensions reduced in relation to those in the balance of the apparatus 50. A transverse bore 68, preferably linear, is formed in the body 54 adjacent is second end. Preferably, the bore 68 extends through the entire body 54 and is of uniform cross-sectional size. The bore 68 should be of sufficient size to permit insertion of a pulling tool, such as a screwdriver, therein and therethrough.

The apparatus 50 should each be formed from a strong and durable material. In a preferred embodiment, the body 54 is formed from mild stainless steel, and is machined to the required shape. In one embodiment, the end-to-end length of the body 54 is 3 inches, and its external diameter is 0.75 inches.

Figure 10:
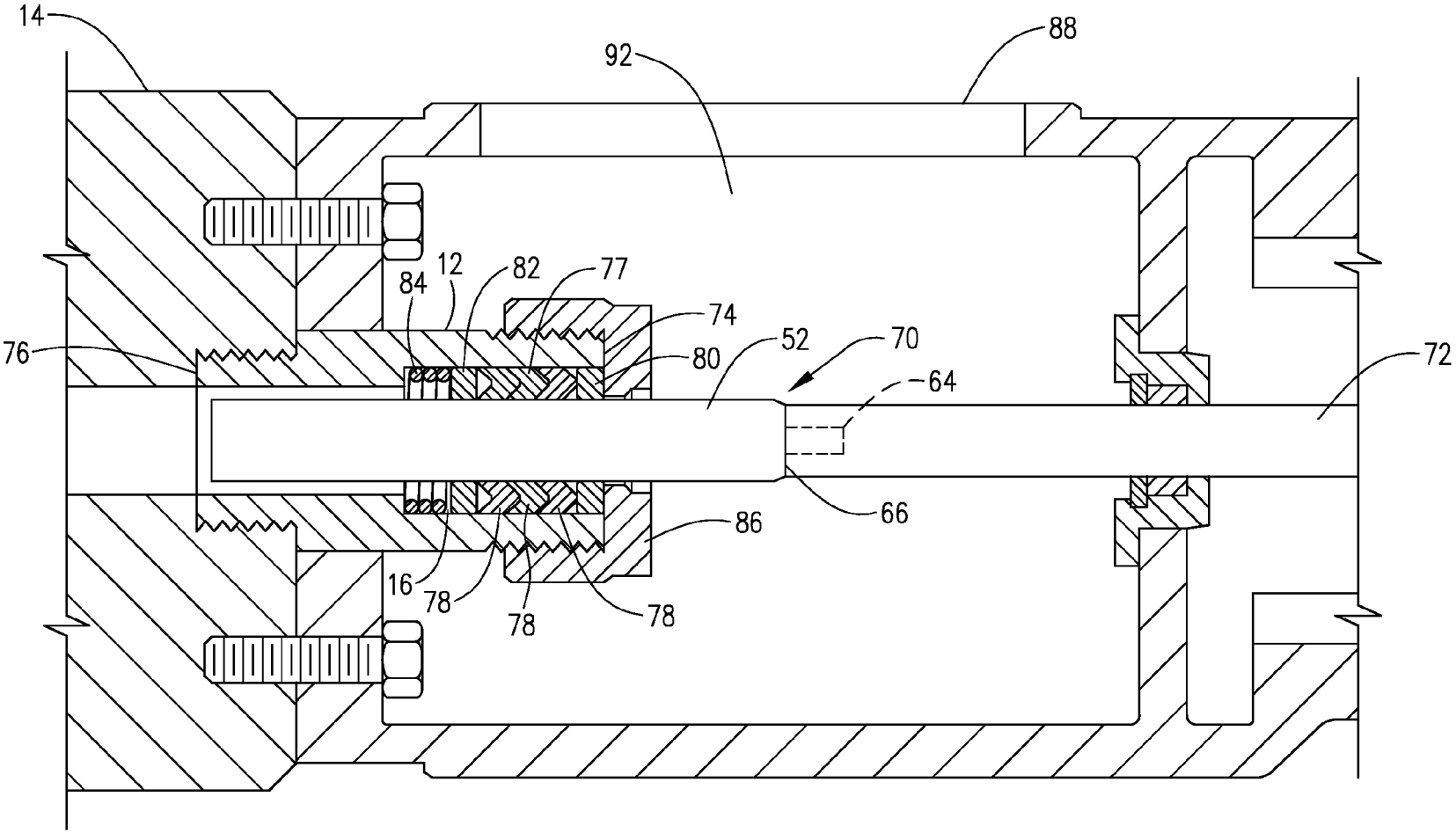
FIG. 10 shows a portion of a pump having a stuffing box. The stuffing box is shown in cross-section.
Figure 11:
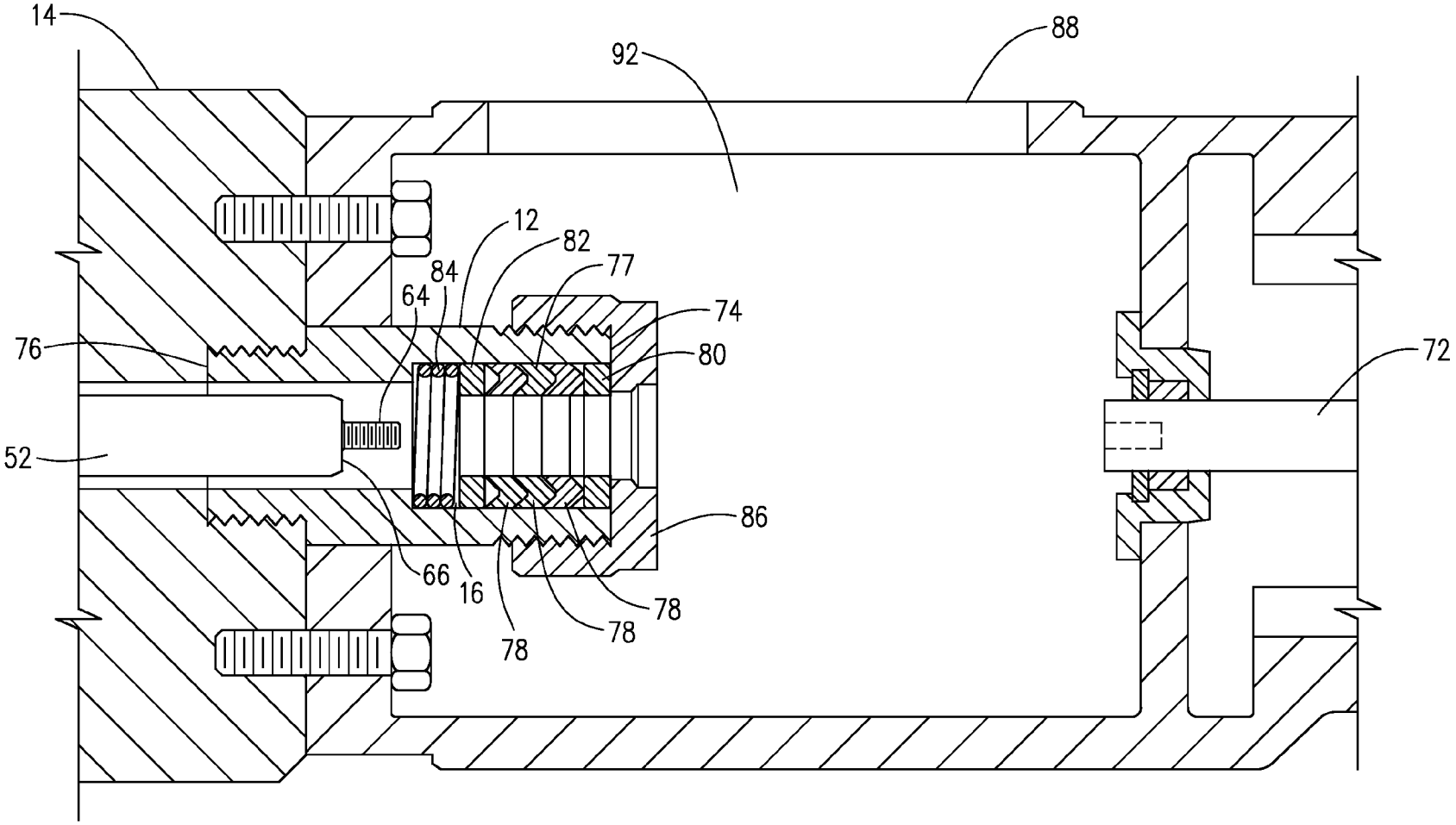
FIG. 11 shows the pump of FIG. 10, after the first and second rods of the rod assembly have been separated. Each of the rods has been retracted in order to provide access to the stuffing box.

FIG. 10 shows a portion of a pump 14 with which the apparatus 10 may be used. The pump 14 includes a reciprocating rod assembly 70 formed from first rod 52 and a second rod 72, which may comprise a pony rod. The first and second rods 52 and 72 are releasably joined in end-to-end relationship, preferably by mating threads.

During normal operation of the pump 14, the first rod 52 extends through and reciprocates within a stuffing box 12 having an open first end 74 and an open second end 76. Typically, the stuffing box 12 is permanently secured to the body of the pump 14.

The stuffing box 12 is loaded with a plurality of coaxially disposed packing elements 77. The packing elements include a plurality of contiguous seals 78 disposed in stacked relationship. In the embodiment shown in the Figures, three such seals 78 are provided. The packing elements may further comprise an adapter element 80 and a retainer element 82, situated on opposite sides of the stacked seals 78. The adapter element 80 is situated immediately adjacent the first end 74 of the stuffing box 12. The packing elements may further comprise a spring 84, situated adjacent the retainer element 82 at the second end 76 of the stuffing box 12. The stuffing box 12 is releasably closed at its first end 74 by a nut 86, such as a castle nut, which is preferably secured to the stuffing box 12 by mating threads. The packing elements 77 and the nut 86 are characterized by central axial openings that permit the first rod 52 to extend closely, but clearingly, therethrough.

During operation of the pump 14, reciprocation of the rod assembly 70 causes the seals 78 to wear. In order to keep the pump 14 operating efficiently, these seals 78 must be replaced periodically. A port 88 formed in a wall of the pump 14 provides access to the service area 92 around stuffing box 12 for this replacement operation.

Because the seals 78 are tightly packed within the stuffing box 12, their removal and replacement can be difficult. Seal replacement is further complicated by the limited space available in the area around the stuffing box 12, as shown in FIG. 10. As a result, manual and tool access to the stuffing box is highly restricted. In some instances, replacement must be performed under challenging outdoor field conditions. All of these factors can make seal replacement a tedious and time-consuming process.

When conventional hand tools are used, the replacement seals and other packing elements can easily be deformed or otherwise damaged during the replacement process. Likewise, use of such tools during the replacement process can scratch or otherwise damage the inner surfaces of the stuffing box 12. These kinds of damage can interfere with efficient pump operation.

FIGS. 10-15 show how the loading apparatus 10 can be used to replace packing elements with greater speed and accuracy, and less risk of damage to pump components. During the initial stage of replacement, shown in FIG. 11, the first and second rods 52 and 72 of the rod assembly 70 are disconnected. The pump mechanism is used to pull first rod 52 out of the stacked packing elements 77. Similarly, the second rod 72 is drawn away from the stuffing box 12.

Figure 12:
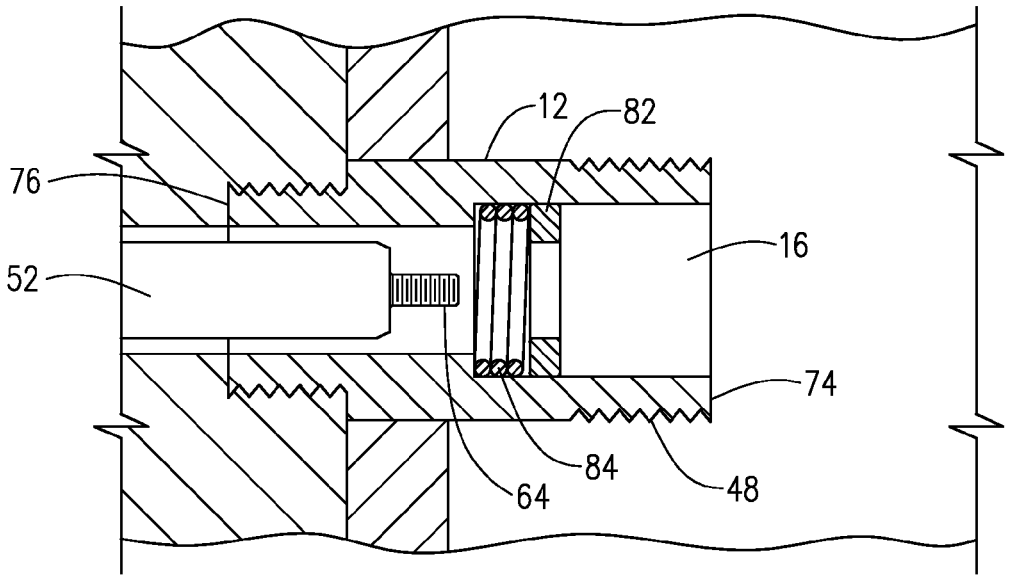
FIG. 12 is an enlarged cross-sectional view of the stuffing box of the pump shown in FIGS. 10 and 11 at a later stage of the loading process. The nut, adapter element and seals have been removed from the stuffing box.

In the next stage of replacement, shown in FIG. 12, the nut 86 is unthreaded from the stuffing box 12. The adapter element 80 and the plural seals 78 are then extracted from the stuffing box 12. A hook or other tool may be used to help in removing these components. The retainer element 82 and spring 84 are ordinarily not removed.

The loading apparatus 10 is used for the next stages of the replacement process. The plunger 30 is extended, and a plurality of replacement seals 90 are loaded coaxially into the internal chamber 26 of the apparatus 10. Because the apparatus 10 is relatively small and portable, this loading step can be performed while the apparatus 10 is disconnected from the stuffing box 12. More preferably, the loading operation is performed at a location outside of, or away from, the pump 14. The often severe limitations on manual and visual access around the pump box 12 thus do not interfere with arranging the replacement seals 90 coaxially within the apparatus 10.

Figure 13:
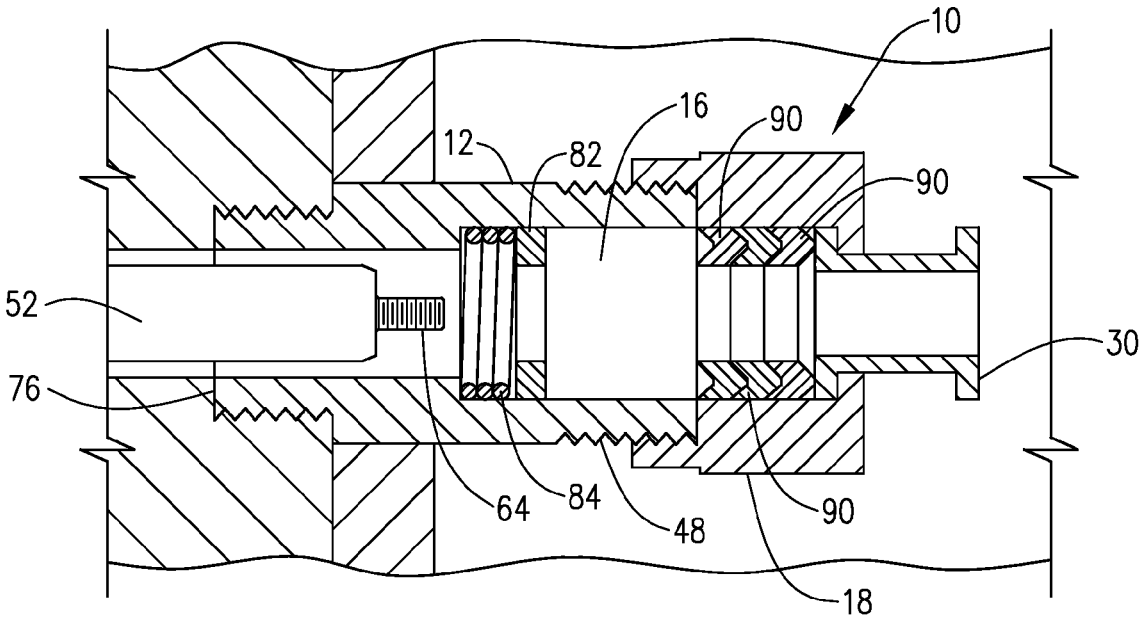
FIG. 13 shows the stuffing box of FIG. 12 at a later stage of the loading process. A loading apparatus has been installed on the stuffing box. The loading apparatus has been loaded with seals, with its plunger in its extended position.

As shown in FIG. 13, the coaxial arrangement of replacement seals 90 is maintained when the apparatus 10 is manually moved into the pump 14 through port 88, and engaged with the stuffing box 12. The two components are threaded together with mating threads 44 and 48, thereby disposing the internal chambers 16 and 26 in coaxial engagement. The plunger 30 remains in its extended position during these steps.

Figure 14:
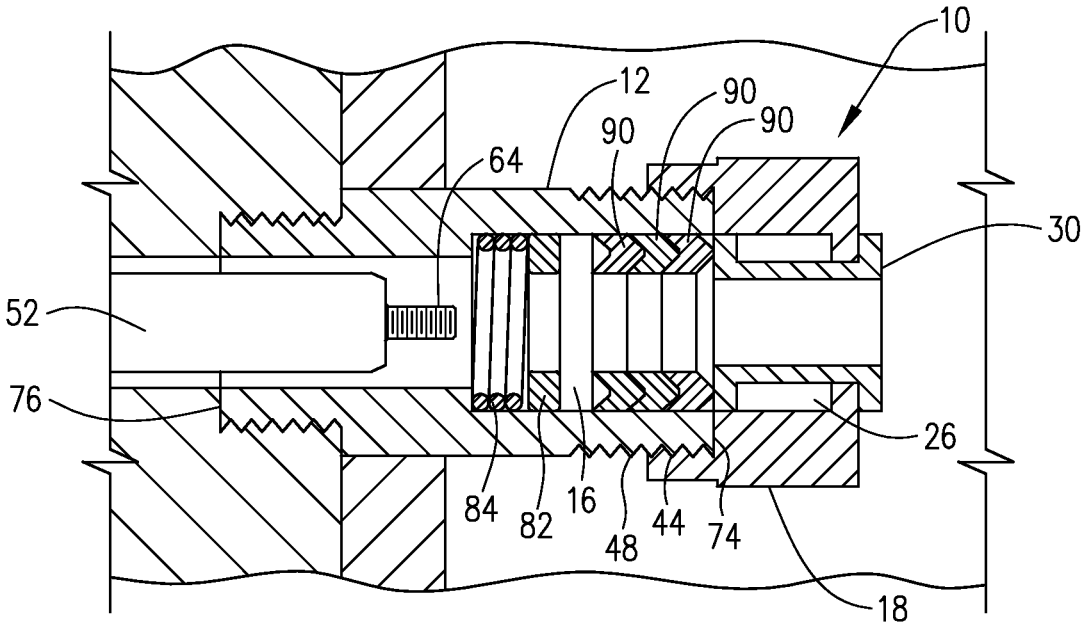
FIG. 14 shows the stuffing box and loading apparatus of FIG. 13 at a later stage of the loading process. The plunger of the loading apparatus has been depressed, thereby transferring the loaded seals into the stuffing box.

The next stage of the replacement process is shown in FIG. 14. While the internal chambers 16 and 26 remain in coaxial engagement, the plunger 30 is axially depressed to its depressed position, causing the piston 38 to push the replacement seals 90 into the internal chamber 16 of the stuffing box 12. The relatively large surface area of the piston 38 assures that the force of depression is distributed uniformly, so that the seals 90 do not deform or move out of coaxial alignment as they are transferred into the stuffing box 12. The force required to depress plunger 30 can conveniently be provided by the pump mechanism, which can push the second rod 72 against flange 40.

Figure 15:
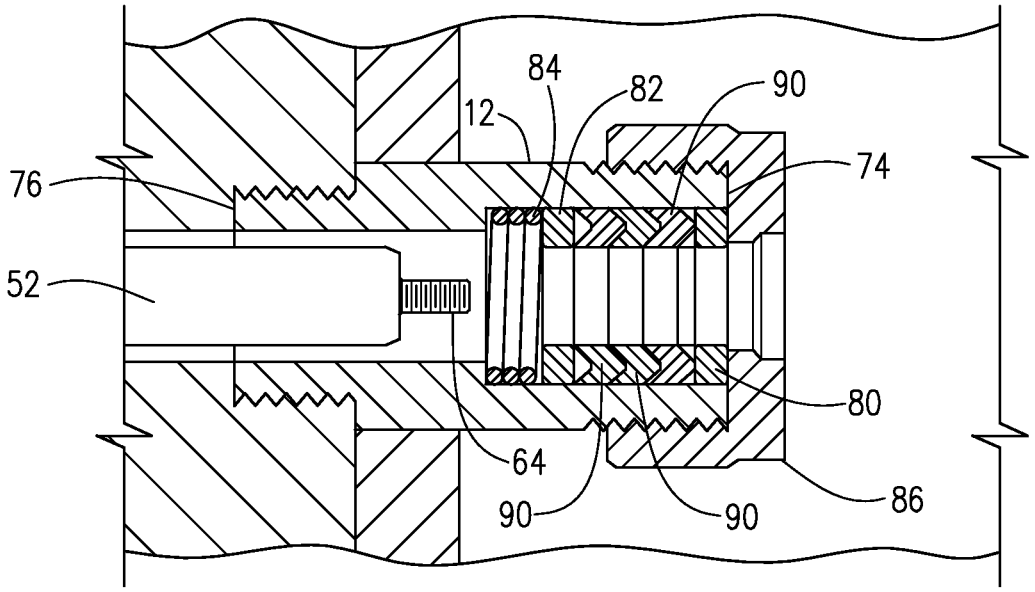
FIG. 15 shows the stuffing box of FIG. 14 at a later stage of the loading process. The loading apparatus has been removed, and the adapter element and nut have been reinstalled.
Figure 18:
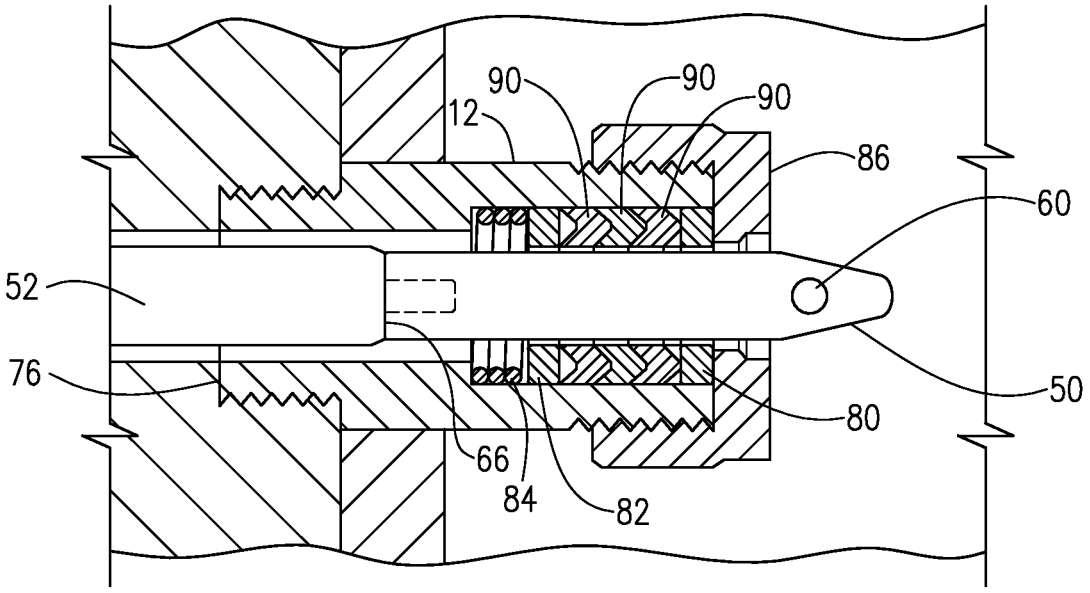

In the next stage of the replacement process, the barrel 18 is released from engagement with the stuffing box 12, by unthreading, and the apparatus 10 is removed from the pump 14. The replacement seals 90 are next pushed further into the stuffing box 12, preferably by use of a separate tool, until adapter element 80 can fitted atop the stacked seals 90. The nut 86 is then reattached to the first end 74 of the stuffing box 12, as shown in FIG. 15.

In order to complete reassembly of the pump 14, the first rod 52 must be rejoined to the second rod 72. During the seal replacement process, it was necessary to withdraw the first rod 52 to a relatively inaccessible position outside the stacked packing elements 77 within the stuffing box 12. It is now necessary to return the first rod 52 to the service area 92, where it may be reconnected the second rod 72.

The apparatus 50 is used to draw the end 66 of the first rod 52 through the stuffing box 12 and into the service area 92. The first end 56 of the body 54 is inserted through the axial opening in the nut 86, into the first end 74 of the stuffing box 12, and through the axial openings in the stacked packing elements. The body 54 of apparatus 50 has cross-sectional dimensions that are sufficiently small to allow it to be clearingly received through these components.

The body 54 is pushed into the stuffing box 12 until the first end 56 contacts the first rod 52. The apparatus 50 is then rotated until the first end of the body is in threaded engagement with the end 66 of the first rod 52. More particularly, the body 54 is rotated until the internal threads 62 mate with the threads 64 of the first rod 52, as shown in FIG. 16.

Figure 17:
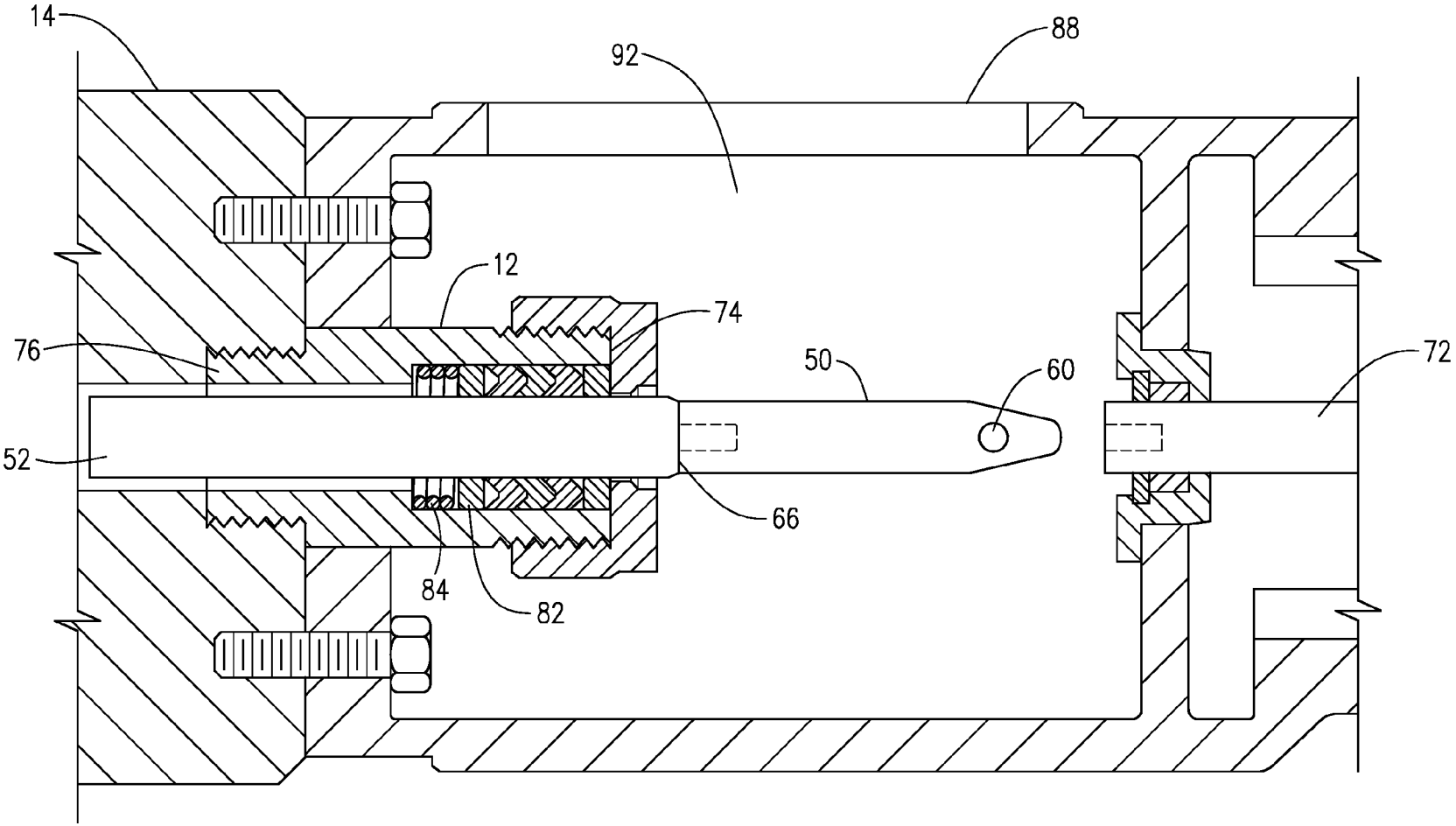
FIG. 17 shows the stuffing box of FIG. 15, and its surrounding pump components, at a final stage of the loading process. The retrieval apparatus, and the attached end of the first rod, have been pulled from the stuffing box. The first rod may now be reengaged with the second rod.

Once the apparatus 50 and first rod 52 are in threaded engagement, the body 54 is pulled from its second end 58 until its first end 56 exits the stuffing box 12, as shown in FIG. 17. To assist in pulling the second end 58, a tool, such as a screwdriver, may be inserted into the transverse bore 60. Once engaged within the bore 60, the inserted tool is used to pull the second end 58 of the body 54.

When the end 66 of the first rod 52 emerges from the stuffing box 12, the apparatus 50 is unthreaded from the first rod 52, which is then reconnected to the second rod 72. The reassembled pump 14 is now ready for use.

The loading apparatus 10 and retrieval apparatus 50 may be combined in the form of a kit, and used to replace a pump's packing elements and thereafter reassemble the pump.

Changes may be made in the construction, operation and arrangement of the various parts, elements, steps and procedures described herein without departing from the spirit and scope of the invention as described in the following claims.

The invention claimed is:

1. An apparatus for packing a stuffing box having an internal chamber, comprising:

a hollow barrel having interior side walls that define an internal chamber having the same cross-sectional dimensions as the internal chamber of the stuffing box, the barrel having a first axis, wherein said first axis runs longitudinally through the center of the hollow barrel;

a plunger disposed for axial reciprocal sliding movement within the internal chamber of the barrel, the plunger having an enlarged piston formed at one end thereof and situated within the internal chamber;

the stuffing box having a second axis running longitudinally through the center of said stuffing box; and a connection system for releasable maintaining the internal chamber of the barrel and the stuffing box in coaxial engagement with respect to said first axis and said second axis.

2. The apparatus of claim 1 in which the connection system comprises threads formed on a surface of the barrel that can mate with threads formed on a surface of the stuffing box.

3. The apparatus of claim 1 in which the internal chambers of the barrel and the stuffing box are cylindrical in shape.

4. An assembly comprising:

the apparatus of claim 1; and a stuffing box releasably secured to the barrel of the apparatus in coaxial engagement therewith.

5. The assembly of claim 4, further comprising:

a pump, of which the stuffing box is a component.

6. The assembly of claim 4, further comprising:

at least one solid packing element installed within the internal chamber of the barrel of the apparatus in coaxial relationship thereto.

7. The assembly of claim 6, further comprising:

a pump, of which the stuffing box is a component.

8. The apparatus of claim 6 in which a plurality of solid and contacting packing elements is installed within the internal chamber of the barrel.

9. The apparatus of claim 1 in which the internal chamber of the barrel is characterized by uniform cross-sectional dimensions.

10. The apparatus of claim 1 in which the plunger is formed from a shaft having opposed first and second ends, in which the piston is formed at the first end, and further comprising:

an enlarged flange formed at the second end of the shaft and situated outside the internal chamber.

11. The apparatus of claim 1 in which the plunger is formed from a shaft having opposed first and second ends, in which the piston is formed at the first end, and further comprising:

an enlarged flange formed at the second end of the shaft and having cross-sectional size and shape identical to that of the piston.

12. The apparatus of claim 11 in which the flange is situated outside the internal chamber.

13. A method of loading a stuffing box having an internal chamber, comprising:

loading at least one solid packing element into the internal chamber of the barrel of the apparatus of claim 1 while the apparatus is disconnected from the stuffing box;

actuating the connection system to coaxially engage the internal chambers of the barrel and the stuffing box;

while the internal chambers are coaxially engaged, axially depressing the plunger into the barrel, until the contents of the internal chamber of the barrel have been transferred into the internal chamber of the stuffing box; and releasing the barrel from engagement with the stuffing box.

14. The method of claim 13 in which the stuffing box is a component of a pump.

15. The method of claim 13 in which the loading step is carried out by loading a plurality of solid packing elements into the barrel.

16. A kit comprising:

an apparatus for packing a stuffing box having an internal chamber, comprising:

a hollow barrel having interior side walls that define an internal chamber having the same cross-sectional dimensions as the internal chamber of the stuffing box, the barrel having an axis;

a plunger disposed for axial reciprocal sliding movement within the internal chamber of the barrel, the plunger having an enlarged piston formed at one end thereof and situated within the internal chamber; and a connection system for releasably maintaining the internal chambers of the barrel and the stuffing box in coaxial engagement; and a retrieval apparatus comprising:

a body having a first end and a second end, the body comprising:

an axially extending bore formed at the first end, the bore having internally formed threads.

17. The apparatus of claim 16 in which the body of the retrieval apparatus is tapered adjacent its second end.

18. The kit of claim 16 in which the internal chamber of the barrel is characterized by uniform cross-sectional dimensions.

19. The kit of claim 16 in which the plunger is formed from a shaft having opposed first and second ends, in which the piston is formed at the first end, and further comprising:

an enlarged flange formed at the second end of the shaft and situated outside the internal chamber.

20. The kit of claim 16 in which the plunger is formed from a shaft having opposed first and second ends, in which the piston is formed at the first end, and further comprising:

an enlarged flange formed at the second end of the shaft and having cross-sectional size and shape identical to that of the piston.

21. The kit of claim 16 in which the retrieval apparatus is further characterized by:

a transverse bore formed adjacent the second end.

* * * * *